United States Patent [19]

Smith et al.

[11] 3,951,331

[45] Apr. 20, 1976

[54] RECLOSABLE CLOSURE

[75] Inventors: Ernest L. Smith; George E. MacEwen, both of Kansas City, Mo.

[73] Assignee: Phillips Petroleum Company, Bartlesville, Okla.

[22] Filed: May 29, 1974

[21] Appl. No.: 474,230

[52] U.S. Cl. ..... 229/43; 229/51 TC; 229/5.6; 220/258; 215/253

[51] Int. Cl.[2] ..... B65D 5/64; B65D 5/54

[58] Field of Search ..... 215/255, 254, 253; 220/258; 229/51 R, 51 TC, 43, 5.6

[56] References Cited

UNITED STATES PATENTS

| | | | |
|---|---|---|---|
| 3,108,708 | 10/1963 | Betner | 229/51 TC |
| 3,335,939 | 8/1967 | Robinson, Jr. | 229/51 TC |

FOREIGN PATENTS OR APPLICATIONS

| | | | |
|---|---|---|---|
| 86,150 | 4/1957 | Netherlands | 229/51 TC |

*Primary Examiner*—William Price
*Assistant Examiner*—Douglas B. Farrow

[57] ABSTRACT

A closure having at least two layers adapted to be fixed to the end of a container to close the same the inner layer of the closure being scored on its inside as well as its outside surface in a manner to permit rupturing of the layer between the score lines when a force acts upon the outer layer to form a shouldered removed closure portion receiving ledge with which the removed portion will mate upon reclosing the container. In an embodiment, enclosure is crimped to the end of the container. In another embodiment there is provided between layers a pliable film, e.g., aluminum foil of size sufficient to extend over the end of the container so that when the removed portion is replaced the foil can be used to substantially seal the replaced portion to the end of the container and to retain it there. Since the sealing surface is broken when the container is opened, any tampering with the container will be readily observable.

18 Claims, 14 Drawing Figures

RECLOSABLE CLOSURE

This invention relates to the production of sealed containers. In one of its aspects, the invention relates to the sealing or capping of an end of a container to close the same applying thereto a closure at least a portion of which is removable to open the container to reach its contents and is replaceable to again close or seal the container.

In one of its concepts the invention provides a container closure a portion of which is removable by a rupture resulting in and providing a removed portion receiving ledge. In another of its concepts, the invention provides a closure structure such that upon rupturing the same to remove a portion thereof there will remain a shouldered ledge adapted to receive back said portion and to mate therewith at the rupture. In a still further concept of the invention, a closure comprising at least two layers of material bonded permanently together has an outer layer adapted to be acted on by force to remove at least a portion of the closure from the container by rupture to open the closed container and an inner layer which is fixed to the end of the container and which is ruptured by said force to leave the closure portion receiving ledge above described. In another concept of the invention, there is interpositioned between the outer layer and the inner layer a pliable film of foil of size such that upon replacing the removed portion, with which the film or foil is also removed, the film or foil can be manually or otherwise pressed to the container to seal its contents and to aid in retention of the closure portion which has been replaced, as described. In a further concept, according to a now preferred embodiment, the removable closure portion is removed by causing a rupture to take place essentially between two score lines one of which is on the inner surface of the inner layer and the other of which is on the outer surface of the inner layer the inner surface score line in the plane of said inner layer being removed from the score line in the outer surface of said inner layer, the score line in the inner surface of said inner layer being farther from the sides of the container than is the score line on the outer surface of said inner layer.

We have conceived a novel structure for a container or can closure of a multi-layered, permanent assembly type which is so structured and shaped that it can be placed into sealing engagement with the end of a container and retained thereby, a portion of said closure being removable by causing an inner, sealing layer to rupture along and between score lines provided on both the inner and outer surfaces of said inner layer thereby to form a removed closure portion receiving shouldered ledge with which the removed closure portion can mate upon being applied to reclose the container. We have also conceived of a modification in which there is interpositioned between layers of the closure before it is applied to the container or can a film or foil which is adapted to the crimped manually or otherwise to the end of the container when the removed portion has been replaced, thus, to aid in retaining the removed closure portion to the end of the can and sealing the contents of the can or container.

It is an object of this invention to provide a closure for a container. It is another object of this invention to provide a removable-replaceable closure for a container. It is a further object of this invention to provide a closure a portion of which can be removed to reach the contents of a container or can said portion being replaceable and having means for substantially sealing the container or can. A further object of this invention is to provide a closure assembly which can be crimped to the open end of a container. A further object still is to provide a closure structure which when there is a force applied thereto in an effort to open a container to which it is attached will rupture in a manner to prevent reclosing of the container. A further object is to provide a closure, the removal of which from the container will make any tampering thereof readily observable.

Other aspects, concepts, objects and several advantages of the invention are apparent from a study of this disclosure, the drawing and the appended claims.

According to the present invention, there is provided a closure adapted to be fixed to an open end of a container, comprising at least two layers of material bonded permanently together, an outer layer adapted to be acted on by a force to remove at least a portion of said closure from said container to open said container when said closure has been fixed in sealing relationship to said end of said container, an inner sealing layer, said inner sealing layer having two score lines, one on its inner surface and one on its outer surface, the inner surface score line in the plane of said inner layer being removed from the outer surface's score line and being farther from the sides of said container, said outer surface score line being positioned so that when the closure is fixed to said end it will be removed by rupturing between said score lines, said inner layer being of a tensile strength such that when the closure is acted on by said force the score lines will lead to rupture of the inner layer between said score lines, thereby permitting the removal of said portion of said container to leave in said open end of said container a shouldered ledge adapted to receive back said closure portion when it has been removed and to mate therewith at the rupture.

Still according to the present invention, there is provided a closure as described wherein the interceding layer is of size and shape such as to close said open end of said container when fixed to said open end of said container.

Further still according to the invention, the closure is sized to at least sit in the said open end of said container and there is interpositioned and fixed between the layers a pliable, sealing film or foil which extends beyond the edge of said open end of said container, said film being adapted to be crimped into sealing engagement with said edge, the layers being sealed to said film thereby forming a single unit, said film functioning upon replacement of said portion after its removal as a seal for said container and to aid in retaining the removed portion in its replaced position, thereby rendering the container tamper proof, e.g., an aluminum foil which will register and therefor reveal signs of having been tampered with.

Still further according to the invention, the closure is such that upon crimping or fixing to the end of said container it is inset or dished-in so that when the removal portion has been ruptured and removed from the closure there will be left in the open end of the container an apertured surface encompassing a shouldered portion receiving ledge.

Figure 1:
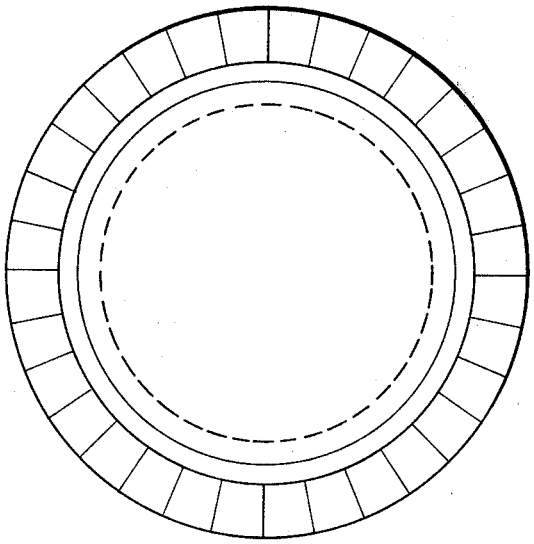

Referring now to FIG. 1, there is shown the inner of a two-layered closure. This inner layer is provided with score lines. The unbroken line shows an outer score line in the outer surface of the inner layer. The broken line shows a score line on the inner surface of the inner layer. The broken score line is located inward of the unbroken score line.

Figure 2:
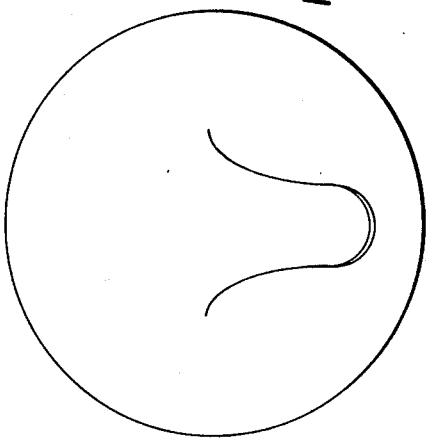
FIGS. 1–4 shows various views of a closure and its constituent elements according to the invention.
Figure 3:
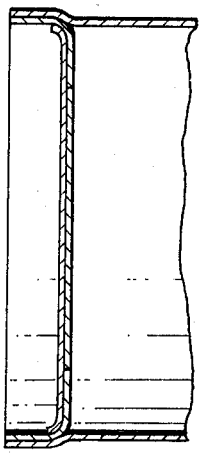

At FIG. 2 is shown the outer of the two-layered assembly or closure. It is provided with a pull tab as shown. The two layers are bonded together. Usually the inner layer at FIG. 1 will be made of a readily-rupturable material such as cardboard or paper. This paper will be coated as with a plastic, e.g., polyolefin, for example polyethylene. Thus, the outer layer having the pull tab can be adhered by hot melting technique or glue to the inner layer; the hot melt adhesive or glue is contained within the area defined by the outer score line (solid line a). Then the closure is applied to the open end of the container as shown at FIG. 3. To aid in applying the closure to the container there are provided radial score lines as shown at FIG. 1 to provide for ready constricting of the perforable portion of the inner layer as it is crimped into the open end or neck of the container as can be seen at FIG. 3.

Figure 4:
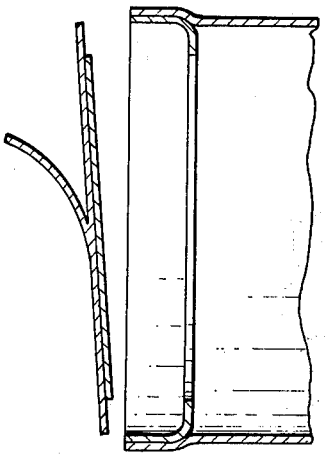

To open the closed container, the pull tab is removed from its nest as with a fingernail and pulled with the thumb and forefinger to cause rupturing of the inner layer where upon a removed portion results as shown above the container and at FIG. 4. It will be seen that a portion of the inner layer has remained in the open end of the container and there is in the neck of the container an apertured surface comprising a shouldered ledge.

Figure 6:
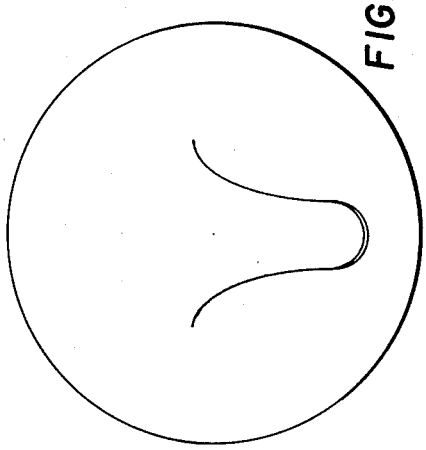
FIGS. 5–8 shows a closure according to the invention which differs from that of FIGS. 1–4 in that the closure is crimped to both the inside and outside surface of the open end of the container when applied thereto.
Figure 8:
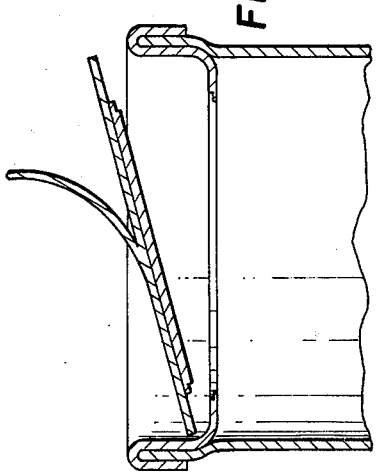
Figure 5:
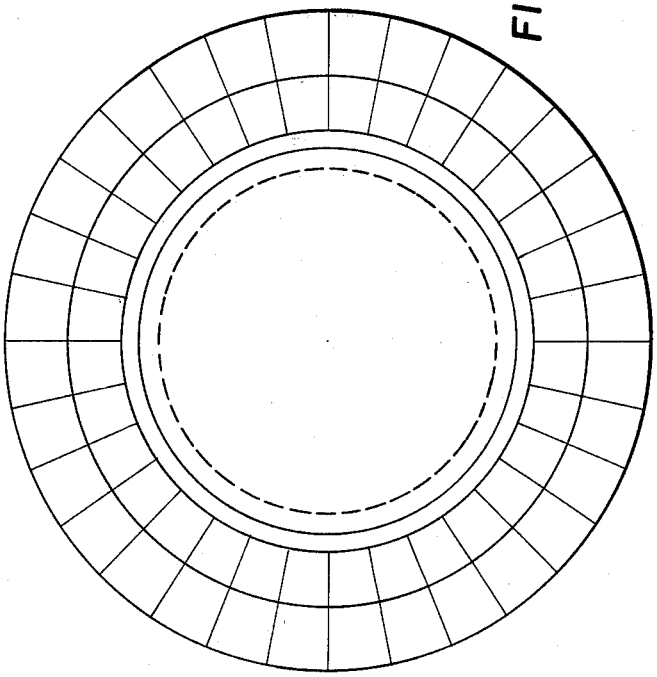
Figure 7:
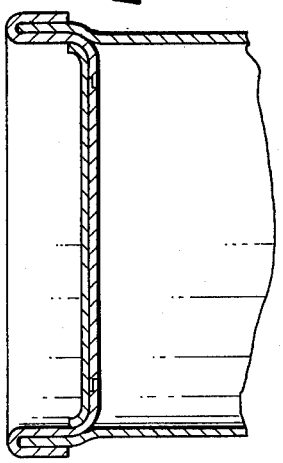

Referring now to FIGS. 5–8, the parts are essentially as earlier described with respect to FIGS. 1–4 except that the inner layer extends considerably beyond the outer layer or pull tab layer and to an extent such that the inner layer can be crimped to both the inside and the outside of the neck of the open end of the container as seen at FIG. 7. Again the part of FIG. 6 is adhered to the part of FIG. 5 by hot melt adhesive or glue confined to the inside of the area defined by the solid score line of the part of FIG. 5.

Figure 11:
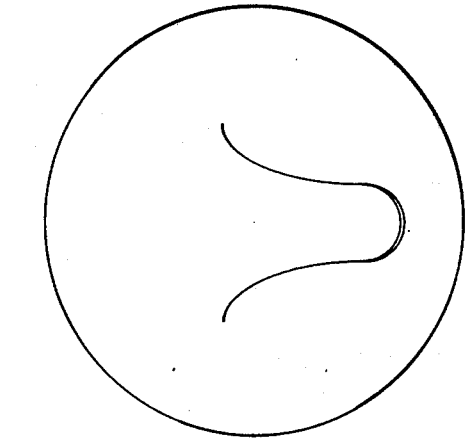
FIGS. 9–14 shows a modification of the closure shown in FIGS. 1–4 in that there is included between the layers of the closure an extending layer of a foil.
Figure 10:
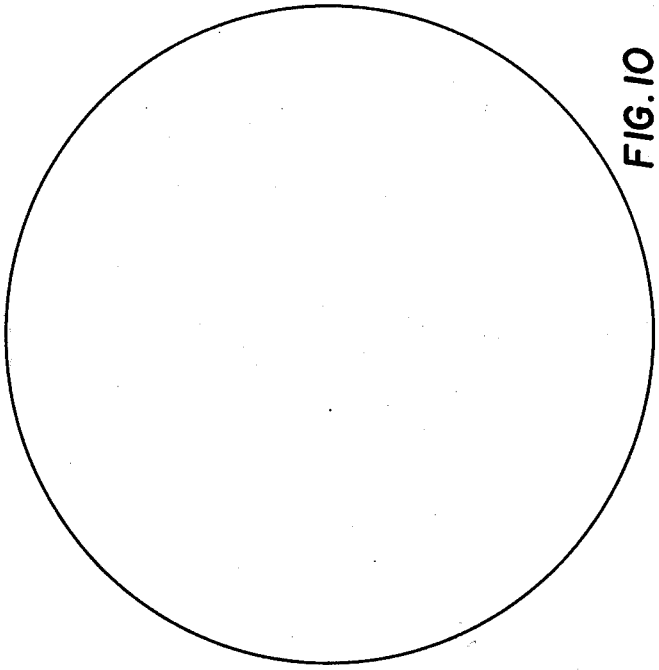
Figure 9:
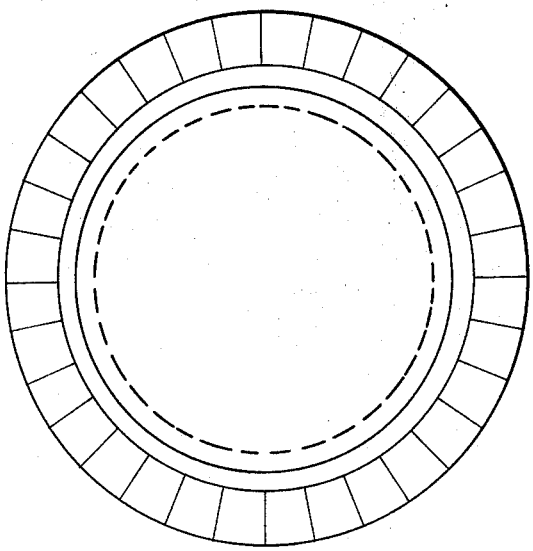
Figure 14:
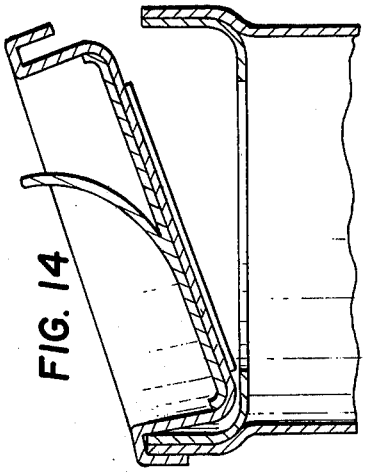
Figure 13:
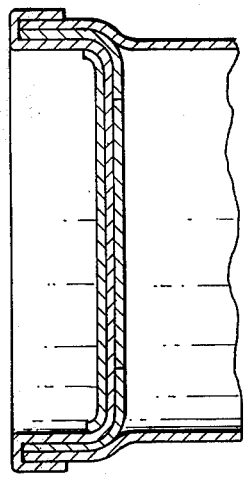
Figure 12:
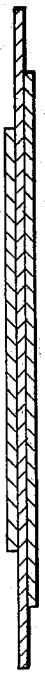

Referring now to FIGS. 7–14, in which the part of FIG. 9 is the inner layer as in FIG. 1; FIG. 10 shows a film or foil, i.e., an aluminum foil large enough to fit over the edge of the container; FIG. 11 is the outer layer of as described in connection with FIG. 2; there is in at FIG. 12 the interpositioned foil (2) of aluminum which is crimped over and around the outside of the end of the container when the closure is fixed thereto. This is shown at in FIG. 13. The foil or film of FIG. 10 is glued the part shown in FIG. 9 within the solid score line of the part of FIG. 9 fore and part the part of FIG. 11 is glued to the film or foil of FIG. 10. Upon opening of the container by pulling and rupturing as described in connection with FIGS. 1–4, there will come from the open end of the container together with the portion being removed the entire aluminum foil layer. Upon reinserting the removed portion into its proper position and centering the same with aid of the shouldered ledge, the aluminum foil can now be manually or otherwise crimped around the edge of the container.

It is within the scope of the invention to extend the inner paper layer to over the end of the wall of the container and even down along the outside thereof as shown in FIGS. 5–8. However, it will be seen that even without so doing the aluminum foil serves a dual function. It serves to seal more effectively the earlier opened container and to retain in place in the shouldered receiving ledge the removed portion of the closure.

The containers and closure means of the invention can be made of any desirable material or materials as one skilled in the art in possession of this disclosure, having studied the same, will understand. Thus, cardboard, hardboard, plywood, or even plastic can be used to produce the container and/or the closure means. When paper is used at least the inner layer of the closure means will be coated with a coating material. Such coating materials are known in the art. For example, wax, polyolefin, e.g., polyethylene can be used other thermoplastic or synthetic materials can be used. The coating on the paper or other material, when a coating is used, will be just sufficient to protect the paper against the contents of the can. A coating need not necessarily be used but is now preferred especially for the stowing of liquids. A thermoplastic film of the thickness of the order of about 0.0055 to about 0.0015 usually will be satisfactory for most uses of the container.

Reasonable variation and modification are possible within the scope of the foregoing disclosure, the drawings, and the appended claims to the invention the essence of which is that there has been provided a closure which is so structured and adapted that a portion of it can be removed by a rupturing between score lines provided in a manner to leave it at the end of a container which has been closed with said closure a removed portion receiving shouldered ledge; also that an interpositioned sealing foil or layer or film between the inner and outer layer of such a closure, as described, is provided wherewith to aid in retaining the replaced, earlier removed portion of the closure in place and to further reseal the open end of the container.

We claim:

1. A closure adapted to be fixed to an open end of a container, said closure comprising at least two layers of material, an inner layer being of size and shape such as to close said open end of said container when fixed to said open end of said container and having two concentric score lines, one on its inner surface and one on its outer surface, with the score line on the inner surface of said inner layer being farther from the walls of said container than the score line on the outer surface of said inner layer, said inner layer being of a tensile strength and said score lines so positioned that when the closure is acted on by sufficient force the score lines will lead to rupture of said inner layer between said score lines, thereby permitting removal of a portion of said inner layer to leave in said open end of said container a shouldered ledge adapted to receive back said portion to mate therewith at the rupture, and an outer layer which is adapted to be acted on by a force to remove said closure and which is bonded to the inner layer in such a manner that the total outer layer will form a single unit with the removed portion of the inner layer after it is removed.

2. A closure according to claim 1 wherein the inner layer and the outer layer are bonded only within the area of the outer score line.

3. A closure according to claim 1 wherein the outer layer is confined within the outer score line on the inner layer.

4. A closure according to claim 1 wherein there is interpositioned and fixed between the layers a pliable, sealing film or foil of such size that it will extend beyond the edge of the end of said container when the inner layer of the closure is fixed in the open end of said container so that said film or foil can be crimped into sealing engagement with said edge, the film being bonded on its outer side to the outer layer and on its inner side to the inner layer so that when the portion of the inner layer is removed said outer layer, said film, and said removed portion will remain a single unit.

5. A closure according to claim 4 wherein the film or foil is bonded to the inner layer only within the area of the outer score line.

6. A closure according to claim 4 wherein the inner layer is of such size that when it is crimped with the edge of the end of the container it does not extend beyond the end of said container.

7. A cylindrical container having a closure as set forth in claim 1 wherein said inner and outer layers of said closure are circular.

8. A closure according to claim 1 wherein the inner layer is large enough so that in fixed position it can extend at least to and be crimped together with the edge of said open end of said container in a manner to form an inset or dished-in closure which, when said portion has been removed, will leave in said open end an apertured surface encompassing said shouldered ledge.

9. A closure according to claim 8 wherein the outer layer is large enough that it will extend into an angular, frictional-gripping relationship with the surface of said inner layer when said closure has been crimped to the edge of said container.

10. A closure according to claim 1 wherein the layers are substantially planar prior to fixing of the closure to the container.

11. A closure according to claim 10 wherein the inner layer, upon being fixed and shaped to the edge of the container, presents a portion of its outer surface to the edge of said outer layer and the edge of the outer layer is in frictional, butting relationship with said portion of the outer surface of said inner layer.

12. A closure according to claim 1 wherein the inner layer is of size sufficient to extend somewhat beyond the edge of the container, is radially scored and is crimped to the end of the container when the closure is fixed thereto, the score lines permitting the shaping of the inner layer to the end of the container during the crimping.

13. A closure according to claim 12 wherein the inner layer is of size sufficient that when it has been crimped to the end of the container it will espouse the inner and the outer surface of said end of said container.

14. A closure according to claim 1 wherein the inner layer is of such size that when it is crimped with the edge of the end of the container that it does not extend beyond the end of said container.

15. A container having the closure of claim 1 fixed in sealing relationship with the end of said container.

16. A closure adapted to be fixed to an open end of a container, said closure comprising at least two bonded layers of material, an inner layer being of size and shape such as to close said open end of said container when fixed to said open end of said container and being scored in such a manner that when the closure is acted on by sufficient force the inner layer will rupture to provide an opening in said container, and an outer layer which is adapted to be acted on by a force to remove said closure, said outer layer being bonded to the inner layer only within the area of the inner layer which is removed to provide the opening in said container.

17. A closure according to claim 16 wherein there is bonded between said outer layer and said inner layer a pliable, sealing film or foil of such size that it will extend beyond the edge of the end of the container when the inner layer of the closure is fixed in the open end of said container so that said film or foil can be crimped into sealing engagement with said edge, said film or foil being bonded to said inner layer only within the area of the inner layer which is removed to provide the opening in said container.

18. A closure according to claim 16 wherein the inner layer is large enough so that in fixed position it can extend at least to and be crimped together with the edge of said open end of said container in a manner to form an inset or dished-in closure and the outer layer is large enough that it will extend into angular, frictional-gripping relationship with the surface of said inner layer when said closure has been crimped to said container.

* * * * *